US006751585B2

(12) United States Patent
Ozawa

(10) Patent No.: US 6,751,585 B2
(45) Date of Patent: Jun. 15, 2004

(54) SPEECH CODER FOR HIGH QUALITY AT LOW BIT RATES

(75) Inventor: Kazunori Ozawa, Tokyo (JP)

(73) Assignee: NEC Corporation, Tokyo (JP)

( * ) Notice: Subject to any disclaimer, the term of this patent is extended or adjusted under 35 U.S.C. 154(b) by 171 days.

(21) Appl. No.: 09/948,481

(22) Filed: Sep. 7, 2001

(65) Prior Publication Data

US 2002/0029140 A1 Mar. 7, 2002

Related U.S. Application Data

(63) Continuation of application No. 09/090,605, filed on Jun. 4, 1998.

(51) Int. Cl.[7] ..... G10L 19/08
(52) U.S. Cl. ..... 704/219; 704/230; 704/222
(58) Field of Search ..... 704/200, 219, 704/220, 222, 223, 230, 258, 262, 264, 500

(56) References Cited

U.S. PATENT DOCUMENTS

| | | | | | |
|---|---|---|---|---|---|
| 5,208,862 | A | * | 5/1993 | Ozawa | 704/216 |
| 5,307,441 | A | * | 4/1994 | Tzeng | 704/222 |
| 5,754,976 | A | * | 5/1998 | Adoul et al. | 704/223 |
| 5,774,840 | A | * | 6/1998 | Taumi et al. | 704/223 |
| 6,055,496 | A | * | 4/2000 | Heidari et al. | 704/222 |
| RE36,721 | E | * | 5/2000 | Akamine et al. | 704/220 |
| 6,094,630 | A | * | 7/2000 | Nomura | 704/230 |

* cited by examiner

*Primary Examiner*—Daniel Abebe
(74) *Attorney, Agent, or Firm*—Dickstein, Shapiro, Morin & Oshinsky, LLP.

(57) ABSTRACT

A speech coder for high quality coding speech signals at low bit rates is disclosed. An excitation quantization unit 12 expresses an excitation signal in terms of a combination of a plurality of pulses. A codebook (i.e., an amplitude codebook 13) collectively quantizes either amplitude or position of pulses, and executes excitation signal quantization other parameter by making retrieval of the codebook.

18 Claims, 9 Drawing Sheets

SPEECH CODER FOR HIGH QUALITY AT LOW BIT RATES

CROSS REFERENCE TO RELATED APPLICATIONS

This is a continuation of U.S. patent application Ser. No. 09/090,605, filed Jun. 4, 1998 in the name of Kazunori Ozawa and entitled Speech Coder for High Quality at Low Bit Rates.

BACKGROUND OF THE INVENTION

The present invention relates to speech coders and, more particularly, to speech coders for high quality coding of speech signals at low bit rates.

A speech coder is used together with a speech decoder such that the speech is coded by the coder and decoded in the speech decoder. A well known method of high efficiency speech coding is CELP (Code Excited Linear Prediction coding) as disclosed in, for instance, M. Schroeder, B. Atal et al, "Code-Excited Linear Prediction: High Quality Speech at very low bit rates", IEEE Proc. ICASSP-85, 1985, pp. 937–940 (Reference 1) and Kleijn et al, "Improved Speech Quality and Efficient Vector Quantization in SELP", IEEE Proc. ICASSP-88, 1988, pp. 155–158 (Reference 2). In this method, on the transmission side, a spectral parameter, representing a spectral energy distribution of a speech signal, is extracted from the speech signal for each frame (of 20 ms, for instance) by using linear prediction (LPC) analysis. Also, the frame is further divided into a plurality of sub-frames (of 5 ms, for instance), and parameters (i.e., delay parameter corresponding to pitch period and gain parameter) are extracted for each sub-frame on the basis of the past excitation signals. Then, pitch prediction of a pertinent sub-frame speech signal is executed by using an adaptive codebook. For an error signal which is obtained as a result of the pitch prediction, an optimum excitation codevector is selected from an excitation codebook (or vector quantization codebook) constituted by a predetermined kind of noise signal, whereby an optimal gain is calculated for excitation signal quantization. The optimal excitation codevector is selected so as to minimize the error power between a signal synthesized from the selected noise signal and the error signal noted above. Index and gain, representing the kind of the selected codevector, are transmitted together with the spectral parameter and adaptive codebook parameter to a multiplexer. Description of the receiving side is omitted.

In the above prior art speech coder, enormous computational effort is required for the selection of the optimal excitation codevector from the excitation codebook. This is so because in the method according to References 1 and 2 described above, the excitation codevector selection is executed by repeatedly performing, for each codevector, filtering or convolution a number of times corresponding to the number of the codevectors stored in the codebook. For example, where the bit number of the codebook is B and the dimension number is N, denoting the filter or impulse response length in the filtering or convolution by K, a computational effort of $N \times K \times 2B \times 8{,}000/N$ per second is required. By way of example, assuming B=10, N=40 and K=10, it is necessary to execute the computation 81,920,000 times per second. The computational effort is thus enormous and economically unfeasible.

Heretofore, various methods of reducing the computational effort necessary for the excitation codebook retrieval have been proposed. For example, an ACELP (Algebraic Code-Excited Linear Prediction) system has been proposed. The system is specifically treated in C. Laflamme et al, "16 kbps Wideband Speech Coding Technique based on Algebraic CELP", IEEE Proc. ICASSP-91, 1991, pp. 13–16 (Reference 3). According to Reference 3, the excitation signal is expressed with a plurality of pulses, and transmitted with the position of each pulse represented with a predetermined number of bits. The amplitude of each pulse is limited to +1.0 or −1.0, and it is thus possible to greatly reduce the computational effort of the pulse retrieval.

The method according to Reference 3, however, has a problem that the speech quality is insufficient, although great reduction of computational effort is attainable. The problem stems from the fact that each pulse can take only either positive or negative polarity and that its absolute amplitude is always 1.0 irrespective of its position. This results in very coarse amplitude quantization, thus deteriorating the speech quality.

SUMMARY OF THE INVENTION

An object of the present invention is to provide a speech coder capable of preventing speech quality deterioration with relatively less computational effort where the bit rate is low.

According to the present invention, there is provided a speech coder comprising a spectral parameter calculation unit for obtaining a spectral parameter (i.e. spectral energy distribution) from an input speech signal and quantizing the obtained spectral parameter, an excitation quantization unit for quantizing an excitation signal of the speech signal by using the spectral parameter and outputting the quantized excitation signal, the excitation being constituted by a plurality of non-zero pulses. The speech coder further comprises a codebook for simultaneously quantizing one of two, i.e., amplitude and position, parameters of the non-zero pulses, the excitation quantization unit having a function of quantizing the non-zero pulses by obtaining the other parameter by retrieval of the codebook.

The excitation quantization unit has at least one specific pulse position for taking a pulse thereat.

The excitation quantization unit preliminarily selects a plurality of codevectors from the codebook and executes the quantization by obtaining the other parameter by retrieval of the preliminarily selected codevectors.

According to another embodiment of the present invention, there is provided a speech coder comprising a spectral parameter calculation unit for obtaining a spectral parameter from an input speech signal for every frame and quantizing the obtained spectral parameter, and an excitation quantization unit for quantizing an excitation signal of the speech signal by using the spectral parameter and outputting the quantized excitation signal. The excitation signal is constituted by a plurality of non-zero pulses. The speech coder further comprises a codebook for simultaneously quantizing the amplitude of the non-zero pulses and a mode judgment circuit for executing mode judgment by extracting a feature quantity from the speech signal. The excitation quantization unit provides, when a predetermined mode is determined as a result of the mode judgment in the mode judgment circuit, functions of a codevector and calculating positions of non-zero pulses for a plurality of sets, executing retrieval of the codebook with respect to the pulse positions in the plurality of sets and executing excitation signal quantization by selecting a combination of a codevector and pulse position, at which a predetermined equation has a maximum or a minimum value.

According to another embodiment of the present invention, there is provided a speech coder comprising a spectral parameter calculation unit for obtaining a spectral parameter from an input speech signal for every frame and quantizing the obtained spectral parameter, and an excitation quantization unit for quantizing an excitation signal of the speech signal by using the spectral parameter and outputting the quantized excitation signal. The excitation signal is constituted by a plurality of non-zero pulses. The speech coder further comprises a codebook for simultaneously quantizing the amplitude of the non-zero pulses and a mode judgment circuit for making a mode judgment by extracting a feature quantity from the speech signal. The excitation quantization unit provides, when a predetermined mode is recognized the excitation quantization unit, functions to calculate positions of non-zero pulses for at least one set, executing retrieval of the codebook with respect to pulse positions of a set having a pulse position, at which a predetermined equation has a maximum or a minimum value, and effects excitation signal quantization by selecting the optimal combination of satisfactory pulse position set and codevector. When a different predetermined mode is recognized, then the excitation quantization unit functions to represent the excitation in the form of linear coupling of a plurality of pulses and excitation codevectors selected from the excitation codebook, and executes excitation signal quantization by making retrieval of the pulses and the excitation codevectors.

According to a further embodiment of the present invention, there is provided a speech coder comprising a frame divider for dividing input speech signal into frames having a predetermined time length, a sub-frame divider for dividing each frame speech signal into sub-frames having a time length shorter than the frame, a spectral parameter calculator which receives a series of frame speech signals outputted from the frame divider, truncates the speech signal by using a window longer than the sub-frame time and does spectral parameter calculation up to a predetermined degree. The speech coder further comprises a spectral parameter quantizer which vector quantizes a LSP parameter of a predetermined sub-frame, calculated in the spectral parameter calculator, by using a linear spectrum pair parameter codebook, a perceptual weight multiplier which receive line prediction coefficients of a plurality of sub-frames, calculated in the spectral parameter calculator, and does perceptual weight multiplication of each sub-frame speech signal to output a perceptual weight multiplied signal. The speech coder also includes a response signal calculator which receives, for each sub-frame, linear prediction coefficients of a plurality of sub-frames calculated in the spectral parameter calculator and linear prediction coefficients restored in the spectral parameter quantizer, calculates a response signal for one sub-frame and outputs the calculated response signal to a subtractor. The speech coder further includes an impulse/response calculator which receives the restored linear prediction coefficients from the spectral parameter quantizer and calculates an impulse response of a perceptual weight multiply filter for a predetermined number of points. An adaptive codebook circuit receives past excitation signals fed back from the output side, the output signal of a subtractor and perceptual weight multiplier filter impulse response, obtains a delay corresponding to the pitch and outputs an index representing the obtained delay. An excitation quantizer calculates and quantizes one of the parameters of a plurality of non-zero pulses constituting an excitation by using an amplitude codebook for collectively quantizing other parameter, i.e., amplitude parameter, of excitation pulses. A gain quantizer reads out gain codevectors from a gain codebook, selects a gain codevector from amplitude codevector/pulse position data and outputs index representing the selected gain codevector to a multiplexer. A weight signal calculator receives the output of the gain quantizer, reads out a codevector corresponding to the index and obtains a drive excitation signal.

Other objects and features will be clarified from the following description with reference to attached drawings.

DETAILED DESCRIPTION OF THE INVENTION

Figure 1:
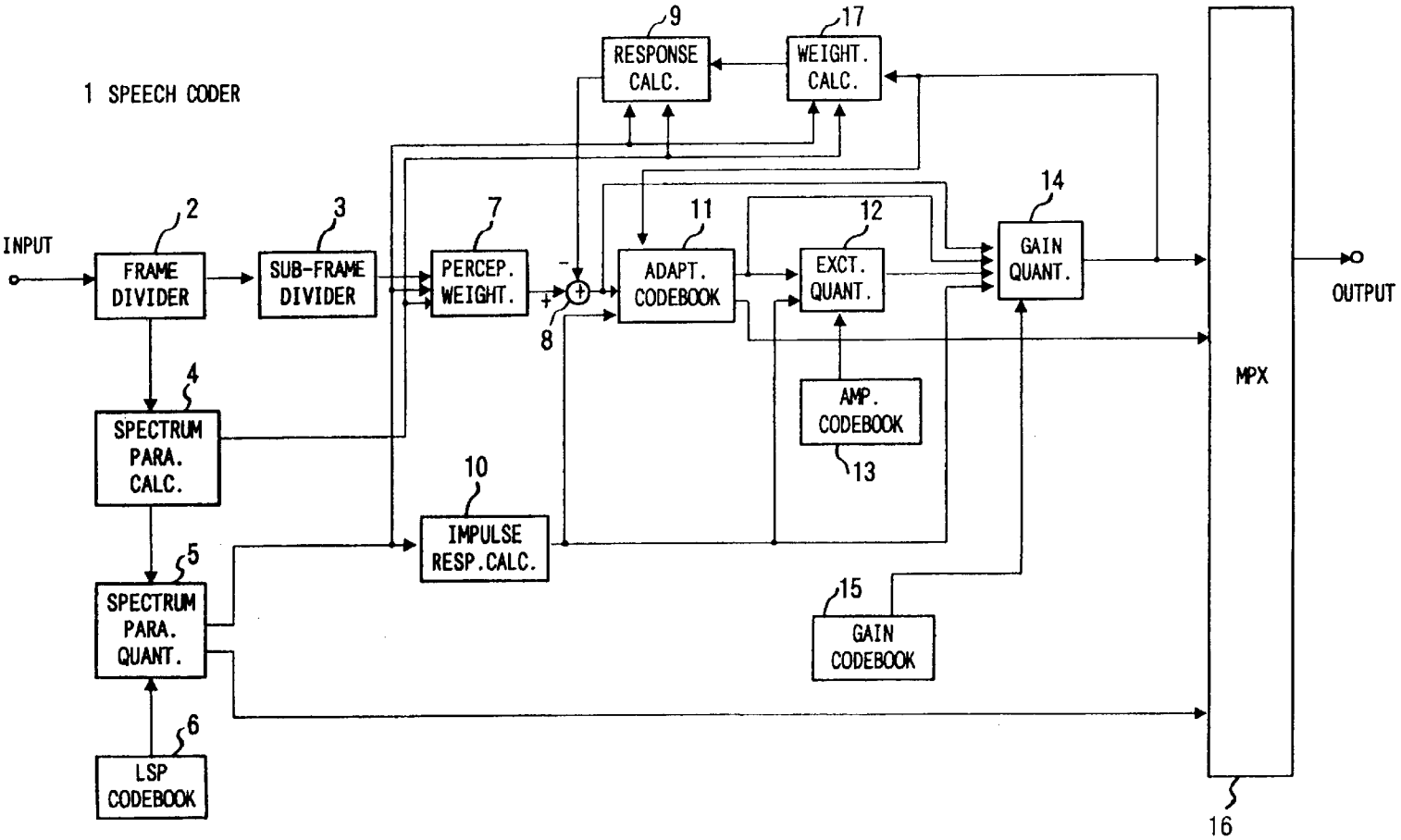
FIG. 1 shows a block diagram of a speech coder according to a first embodiment of the present invention.

Preferred embodiments of the present invention will now be described with reference to the drawings. First, various aspects of the present invention will be summarized as follows:

In a first aspect of the present invention, the codebook which is provided in the excitation quantization unit is retrieved for simultaneously quantizing one of two, i.e., amplitude and position, parameters of a plurality of non-zero pulses. In the following description, it is assumed that the codebook is retrieved for simultaneously quantizing the amplitude parameter of the plurality of pulses.

The excitation is comprised of M non-zero pulses for every frame, when M<N. Denoting the amplitude and position of the i-th pulse (i=1,2 . . . M) by $g_i$ and $m_i$, respectively, the excitation is expressed as $$V(n) = \sum_{i=l}^{M} g_i(n - m_i), \qquad 0 \le m_i \le N - 1 \tag{1}$$

Denoting the k-th amplitude codevector stored in the codebook by $g'_{ik}$ and assuming that the pulse amplitude is quantized, the excitation is expressed as $$V_k(n) = \sum_{i=l}^{M} g'_{ik}\delta(n - m_i), \qquad k = 0, \ldots, 2^{B-1} \tag{2}$$

where B is the bit number of the codebook for quantizing the amplitude. Using the equation (2), the distortion of the reproduced signal from the input speech signal is $$D_k = \sum_{n=0}^{N-1}\left[X_w(n) - \sum_{i=l}^{M} g'_{ik} h_w(n-m_i)\right]^2 \quad (3)$$

where $x_w$ (n) and $h_w$ (n) are the perceptual weight multiplied speech signal and the perceptual weight filter impulse response, respectively, as will be described later.

To minimize the equation (3), a combination of a k-codevector and a pulse position $m_i$ which maximizes the following equation may be obtained.

$$D_{(k,i)} = \left[\sum_{n=0}^{N-1} X_w(n) S_{wk}(m_i)\right]^2 \Big/ \sum_{n=0}^{N-1} S_{wk}^2(m_i) \quad (4)$$

where $S_{wk}(m_i)$ is given as $$S_{wk}(m_i) = \sum_{i=l}^{M} g'_{ik} h_w(n-m_i) \quad (5)$$

Thus, a combination of an amplitude codevector and a pulse position which maximizes the equation (4), is obtained by calculating a pulse position for each amplitude codevector.

In a second aspect of the present invention, in the speech coder according to the first embodiment of the present invention, positions which can be taken by at least one pulse are preliminarily set as limited positions. Various methods of pulse position limitation are conceivable. For example, it is possible to use a method in ACELP according to Reference 3 noted above. Assuming N=40 and M=5, for instance, pulse position limitations as shown in Table 1 below may be executed.

TABLE 1

| |
|---|
| 0, 5, 10, 15, 20, 25, 30, 35 |
| 1, 6, 11, 16, 21, 26, 31, 36 |
| 2, 7, 12, 17, 22, 27, 32, 37 |
| 3, 8, 13, 18, 23, 28, 33, 38 |
| 4, 9, 14, 19, 24, 29, 34, 39 |

Using the technique of Reference 3, the positions which can be taken by each pulse are limited to 8 different positions. It is thus possible to greatly reduce the number of pulse position combinations, thus reducing the computational effort in the calculation of equation (4) compared to the first aspect of the present invention.

In a third aspect of the present invention, instead of making the calculation of equation (4) for all of the $2_B$ codevectors contained in the codebook, a plurality of codevectors are preliminarily selected for making the calculation of equation (4) for only the selected codevectors, thus reducing the computational effort.

In a fourth aspect of the present invention, the codebook is retrieved for simultaneously quantizing the amplitude of M pulses. Also, the positions of the M pulses are calculated for a plurality of sets, and the combination of a pulse position and a codevector which maximizes equation (4), is selected by making the calculation of equation (4) with respect to the codevectors in the codebook for each pulse position in the plurality of sets.

In a fifth aspect of the present invention, the method of the fourth aspect is used, and, like the second aspect, positions which can be taken by at least one pulse are preliminarily set as limited positions.

In a sixth aspect of the present invention, mode judgment is executed by extracting a feature quantity from the speech signal, and the same process as in the fourth aspect of the present invention is executed when the judged mode is found to be a predetermined mode.

In a seventh aspect of the present invention, the method of the sixth aspect is used, and, like the second aspect, positions which can be taken by at least one pulse are preliminarily set as limited positions.

In an eighth aspect of the present invention, the excitation signal is switched in dependence of mode. Specifically, in a predetermined mode, like the sixth aspect of the present invention, the excitation is expressed as a plurality of pulses, and in a different predetermined mode it is expressed as linear coupling of a plurality of pulses and excitation codevectors selected from an excitation codebook. For example, the excitation is expressed as $$V(n) = G_1 \sum_{l-1}^{M} g'_{ik}\delta(n-m_i) + G_2 C_j(n),\ 0 \le j \le 2^{R-1} \quad (6)$$

were $C_j$ (n) is j-th excitation codevector stored in the excitation codebook, $G_1$ and $G_2$ are gains, and R is the bit number of the excitation codebook.

In the predetermined mode, the same process as in the sixth aspect of the present invention is executed.

In a ninth aspect of the present invention, the method of the eighth aspect is used, and, like the second aspect, positions which can be taken by at least one pulse are preliminarily set as limited positions.

FIG. 1 is a block diagram showing a first embodiment of the present invention. A speech coder 1 comprises a frame divider 2 for dividing an input speech signal into frames having a predetermined time length. A sub-frame divider 3 divides each frame speech signal into sub-frames having a time length shorter than the frame. A spectral parameter calculator 4 receives a series of frame speech signals outputted from the frame divider 2, truncates the speech signal by using a window longer than the sub-frame time and does spectral parameter calculation up to a predetermined degree. A spectral parameter quantizer 5 vector quantizes an LSP parameter of a predetermined sub-frame, calculated in the spectral parameter calculator 4, by using a linear spectrum pair parameter codebook (hereinafter referred to as LSP codebook 6). A perceptual weight multiplier 7 receives linear prediction coefficients of a plurality of sub-frames, calculated in the spectral parameter calculator 4, and executes perceptual weight multiplication of each sub-frame speech signal to output a perceptual weight multiplied signal. A response signal calculator 9 receives, for each sub-frame, linear prediction coefficients of a plurality of sub-frames calculated in the spectral parameter calculator 4 and linear prediction coefficients stored in the spectral parameter quantizer 5, calculates a response signal for one sub-frame and outputs the calculated response signal to a subtractor 8. An impulse response calculator 10 receives the restored linear prediction coefficients from the spectral parameter quantizer 5 and calculates an impulse response of a perceptual weight multiply filter for a predetermined number of points. An adaptive codebook circuit 11 receives the past excitation signal fed back from the output side, the output signal of the subtractor 8 and the perceptual weight multiply filter impulse response, obtains a delay corresponding to the pitch and outputs an index representing the obtained delay. An excitation quantizer 12 executes calculation and quantization of one of two parameters of a plurality of non-zero pulses constituting an excitation signal, by using an amplitude codebook 13 for simultaneously quantizing the other parameter, i.e., amplitude parameter, of excitation pulses. A gain quantizer 14 reads out gain codevectors from a gain codebook 15, selects a gain codevector from amplitude codevector/pulse position data and outputs an index representing the selected gain codevector to a multiplexer 16. A weight signal calculator 17 receives the output of the gain quantizer 14, reads out a codevector corresponding to the index and obtains a drive excitation signal.

The operation of this embodiment will now be described.

The frame divider 2 receives the speech signal from an input terminal, and divides the speech signal into frames (of 10 ms, for instance). The sub-frame divider 3 receives each frame speech signal, and divides this speech signal into sub-frames (of 2.5 ms, for instance) which are shorter than the frame. The spectral parameter calculator 4 truncates the speech signal by using a window (of 24 ms, for instance) which is longer than the sub-frame and executes spectral parameter calculation up to a predetermined degree (for instance P=10). The spectral parameter calculation may be executed in a well-known manner, such as LPC analysis or Burg analysis. It is assumed here that the Burg analysis is used. The Burg analysis is detailed in Nakamizo, "Signal Analysis and System Identification", Corna Co., Ltd., 1988, pp. 82–87 (Reference 4), and is not described here.

The spectral parameter calculator 4 also transforms the linear prediction coefficients $\alpha_i$ (i=1, . . . , 10), calculated through the Burg analysis, to an LSP parameter suited for quantization and interpolation. For the transformation of the linear prediction coefficients to the LSP parameter, reference may be made to Sugamura et al, "Speech Data Compression by Linear Spectrum Pair (LSP) Speech Analysis Synthesis System", Trans. IECE Japan, J64-A, 1981, pp. 599–606 (Reference 5). By way of example, the spectral parameter calculator 4 transforms linear prediction coefficients obtained for the 2-nd and 4-th sub-frames through the Burg analysis to an LSP parameter, obtains the LSP parameter of the 1-st and 3-rd sub-frames through linear interpolation, inversely transforms this LSP parameter to restore linear prediction coefficients, and outputs linear prediction coefficients il (i=1, . . . , 10, 1=1, . . . , 5) to the perceptual weight multiplier 7, while also outputting the LSP parameter of the 4-th sub-frame to the spectral parameter quantizer 5.

The spectral parameter quantizer 5 efficiently quantizes the LSP parameter of a predetermined sub-frame by using the LSP codebook 6, and outputs a quantized LSP parameter value, which minimizes distortion given as $$D_j = \sum_{i}^{P} W(i)[LSP(i) - QLSP(i)_j]^2 \tag{7}$$

where LSP(i), QLSP(i)$_j$ and W(i) are i-th degree LSP, j-th result codevector in the LSP codebook 6 and weight coefficients, respectively, before the quantization.

Hereinafter, it is assumed that the LSP parameter quantization is executed in the 4-th sub-frame. The LSP parameter quantization may be executed in a well-known manner. Specific methods are described in, for instance, Japanese Laid-Open Patent Publication No. 4-171500 (Reference 6), 4-363000 (Reference 7), 5-6199 (Reference 8) and T. Nomura et al, "LSP Coding Using VQ-SVQ with Interpolation in 4.075 kbps M-LCELP Speech Coder", IEEE Proc. Mobile Multimedia Communications, 1993, B. 2., pp. 5 (Reference 9), and are not described here.

The spectral parameter quantizer 5 restores the LSP parameter of the 1-st to 4-th sub-frames from the quantized LSP parameter of the 4-th sub-frame. Specifically, the LSP parameter of the 1-st to 3-rd sub-frames is restored through interpolation between the 4-th sub-frame quantized LSP parameter in the present frame and the 4-th sub-frame quantized LSP parameter in the immediately preceding frame. The LSP parameter of the 1-st to 4-th sub-frames can be restored through linear interpolation after selecting a codevector, which minimizes the error power between the non-quantized LSP parameter and the quantized LSP parameter. Further performance improvement is obtainable with an arrangement such as selecting a plurality of candidates for the codevector corresponding to the minimum error power, evaluating cumulative distortion with respect to each candidate and selecting a combination of candidate and LSP parameters corresponding to the minimum cumulative distortion. For details of this arrangement, reference may be had to, for instance, Japanese Patent Application No. 5-8737 (Reference 10).

The spectral parameter quantizer 5 generates, for each sub-frame, linear prediction coefficients $\alpha'_{il}$ (i=1, . . . , 10, 1=1, . . . , 5), obtained through transformation from the restored LSP parameter of the 1-st to 3-rd sub-frames and the quantized LSP parameter of the 4-th sub-frame. The linear prediction coefficients are output to the impulse response calculator 10. The spectral parameter quantizer 5 also outputs an index representing the codevector of the quantized LSP parameter of the 4-th sub-frame to the multiplexer 16.

The perceptual weight multiplier 7 receives the non-quantized linear prediction coefficients $\alpha_{il}$ (I=1, . . . , 10, 1=1 . . . , 5) for each sub-frame from the spectral parameter calculator 4, and does perceptual weight multiplication of the sub-frame speech signal according to Reference 1 to output a perceptual weight multiplied signal.

The response signal calculator 9 receives the linear prediction coefficients $\alpha_{il}$ for each sub-frame from the spectral parameter calculator 4 and the restored linear prediction coefficients $\alpha_{il}$, obtained through quantization and interpolation, for each sub-frame from the spectral parameter quantizer 5. The response calculator 9 calculates a response signal with an input signal set to zero, i.e., d(n)=0, for one sub-frame by using preserved filter memory data, and outputs the calculated response signal to the subtractor 8. The response signal, denoted by $X_z(n)$, is given as $$X_z(n) = d(n) - \sum_{i=l}^{10} a_i d(n-i) + \sum_{i=l}^{10} a_i \gamma^i y(n-i) + \sum_{l-1}^{10} a'_i \gamma^i X_z(n-i) \tag{8}$$

where if $n-1 \leqq 0$, $$y(n-1)=p(N+(n-i)) \tag{9}$$

$$\text{and } x_z(n-i)=s_w(N+(n-i)) \tag{10}$$

were N is the sub-frame length, $\gamma$ is a weight coefficient controlling the perceptual weight multiplication and is equal to the value obtained using equation (12) given below, and $s_w$ (n) and the p (n) respectively represent the output signal of the weight signal calculator 17 and the filter output signal corresponding to the denominator of the right side first term in equation (12) given below.

The subtractor 8 subtracts the response signal from the perceptual weight multiplied signal for one sub-frame, and outputs the difference $x'_w$ (n) given as $$x'_w(n)=x_w(n)-x_z(n) \tag{11}$$

to the adaptive codebook circuit 11.

The impulse response calculator 10 calculates the impulse response $h_w(n)$ of a perceptual weight multiplication filter with a z transform expressed as $$H_w(z) = \left(1 - \sum_{i=l}^{10} a_i z^{-i}\right) \Big/ \left[\left(1 - \sum_{i=l}^{10} a_i \gamma^i z^{-i}\right) \cdot \left(1 - \sum_{i=l}^{10} a_i' \gamma^i z^{-i}\right)\right] \tag{12}$$

for a predetermined number L of points, and outputs the calculated impulse response to the adaptive codebook circuit 11, the excitation quantizer 12 and the gain quantizer 14.

The adaptive codebook circuit 11 receives the past excitation signal v(n) from the gain quantizer 14, the output signal $x'_w(n)$ from the subtractor 8 and the perceptual weight multiplication filter impulse response $h_w(n)$ from the impulse response calculator 10. The adaptive codebook circuit 11 obtains delay T corresponding to the pitch such as to minimize distortion given as $$D_T = \sum_{n=0}^{N-1} x' w^2(n) - \left[\sum_{n=0}^{N-1} x'_w(n) y_w(n-T)\right]^2 \Big/ \left[\sum_{n=0}^{N-1} y_w^2(n-T)\right] \tag{13}$$

where $$y_w(n-T) = v(n-*h_w(n)) \tag{14}$$

where symbol * represents convolution. The adaptive codebook circuit 11 outputs the delay thus obtained to the multiplexer 16.

Gain β is obtained as $$\beta = \sum_{n=0}^{N-1} x'_w(n) y_w(n-T) \Big/ \sum_{n=0}^{N-1} y_w^2(n-T) \tag{15}$$

For improving the delay extraction accuracy with respect to the speech of women and children, the delay may be obtained in a decimal sample value instead of an integral sample. For a specific method of doing so, reference may be had to the, for instance, P. Kroon et al, "Pitch predictors with high temporal resolution", IEEE Proc. ICASSP-90, 1990, pp. 661–664 (Reference 11).

The adaptive code book circuit 11 does pitch prediction using an equation $$e_w(n) = x'_w(n) - v(n-T)*h_w(n) \tag{16}$$

and outputs the error signal $e_w(n)$ to the excitation quantizer 12.

The excitation quantizer 12 takes M pulses as described before in connection with the function.

In the following description, it is assumed that the excitation quantizer 12 has a B-bit amplitude codebook 13 for simultaneous pulse amplitude quantization for M pulses.

The excitation quantizer 12 reads out amplitude codevectors from the amplitude codebook 13 and, by applying all the pulse positions to each codevector, selects a combination of codevector and pulse position, which minimizes an equation $$D_k = \sum_{n=0}^{N-1} \left[e_w(n) - \sum_{i=1}^{M} g'_{ik} h_w(n-m_i)\right]^2 \tag{17}$$

where $h_w(n)$ is the perceptual weight multiplication filter impulse response. In other words, equation (17) is executed for each non-zero pulse position in the L-pulse frame, and the pulse position/amplitude combination which minimizes the computation is selected for the excitation.

The equation (17) may be minimized by selecting a combination of an amplitude codevector k and a pulse position $m_i$ which maximizes an equation $$D_{(k,i)} = \left[\sum_{n=0}^{N-1} e_w(n) s_{wk}(m_i)\right]^2 \Big/ \sum_{n=0}^{N-1} S_{wk}^2(m_i) \tag{18}$$

where $s_{wk}(m_i)$ is calculated by using the equation (5). As an alternative method, the selection may be executed such as to maximize an equation $$D_{(k,i)} = \left[\sum_{n=0}^{N-1} \phi(n) v_k(n)\right]^2 \Big/ \sum_{n=0}^{N-1} S_{wk}^2(m_i) \tag{19}$$

$$\phi(n)v = \sum_{i=n}^{N-1} e_w(i) h_w(i-n), \quad n = 0, \ldots, N-1 \tag{20}$$

The adaptive codebook circuit 11 outputs an index representing the codevector to the multiplexer 16. Also, the adaptive codebook circuit 11 quantizes the pulse position with a predetermined number of bits, and outputs a pulse position index to the multiplexer 16.

The pulse position retrieval may be executed in a method described in Reference 3 noted above, or by referring to, for instance, K. Ozawa, "A Study on Pulse Search Algorithm for Multipulse Excited Speech Coder Realization", IEEE Journal of Selected Areas on Communications", 1986, pp. 133–141 (Reference 12).

It is also possible to preliminarily study, using speech signals, and store a codebook for amplitude quantizing a plurality of pulses. The codebook study may be executed in a method described in, for instance, Linde et al, "An Algorithm for Vector Quantization Design", IEEE Trans. Commum., January 1980, pp. 84–95.

The amplitude/position data are outputted to the gain quantizer 14. The gain quantizer 14 reads out gain codevectors from the gain codebook 15, and selects the gain codevector such as to minimize the following equation.

Here, an example is taken, in which both the adaptive codebook gain and the gain of excitation expressed in terms of pulses are vector quantized at a time.

$$D_k = \sum_{n=0}^{N-1} \left[x_w(n) - \beta'_t v(n-T) * h_w(n=) - G'_t \sum_{i=1}^{M} g'_{ik} h_w(n-m_i)\right]^2 \tag{21}$$

where $\beta'_t$ and $G'_t$ are k-th codevectors in a two-dimensional gain codebook stored in the gain codebook 15. An index representing the selected gain codevector is outputted to the multiplexer 16.

The weight signal calculator 17 receives the indexes, and by reading out the codevectors corresponding to the indexes, obtains drive excitation signal v(n) given as $$v(n) = \beta'_t v(n-T) + G'_t \sum_{i=1}^{M} g'_{ik} \delta_w(n-m_i) \tag{22}$$

The weight signal calculator 17 outputs the drive excitation signal v(n) to the adaptive codebook circuit 11.

Then, using the output parameters of the spectral parameter calculator 4 and the spectral parameter quantizer 5, the weight signal calculator 17 calculates the weight signal $s_w(n)$ for each sub-frame according to equation (2), and outputs the result to the response signal calculator 9.

$$s_w(n) = v(n) - \sum_{i=1}^{10} a_i v(n-i) + \sum_{i=1}^{10} a_i \gamma^i p(n-i) + \sum_{i=1}^{10} a_i' \gamma^i s_w(n-i) \tag{23}$$

Figure 2:
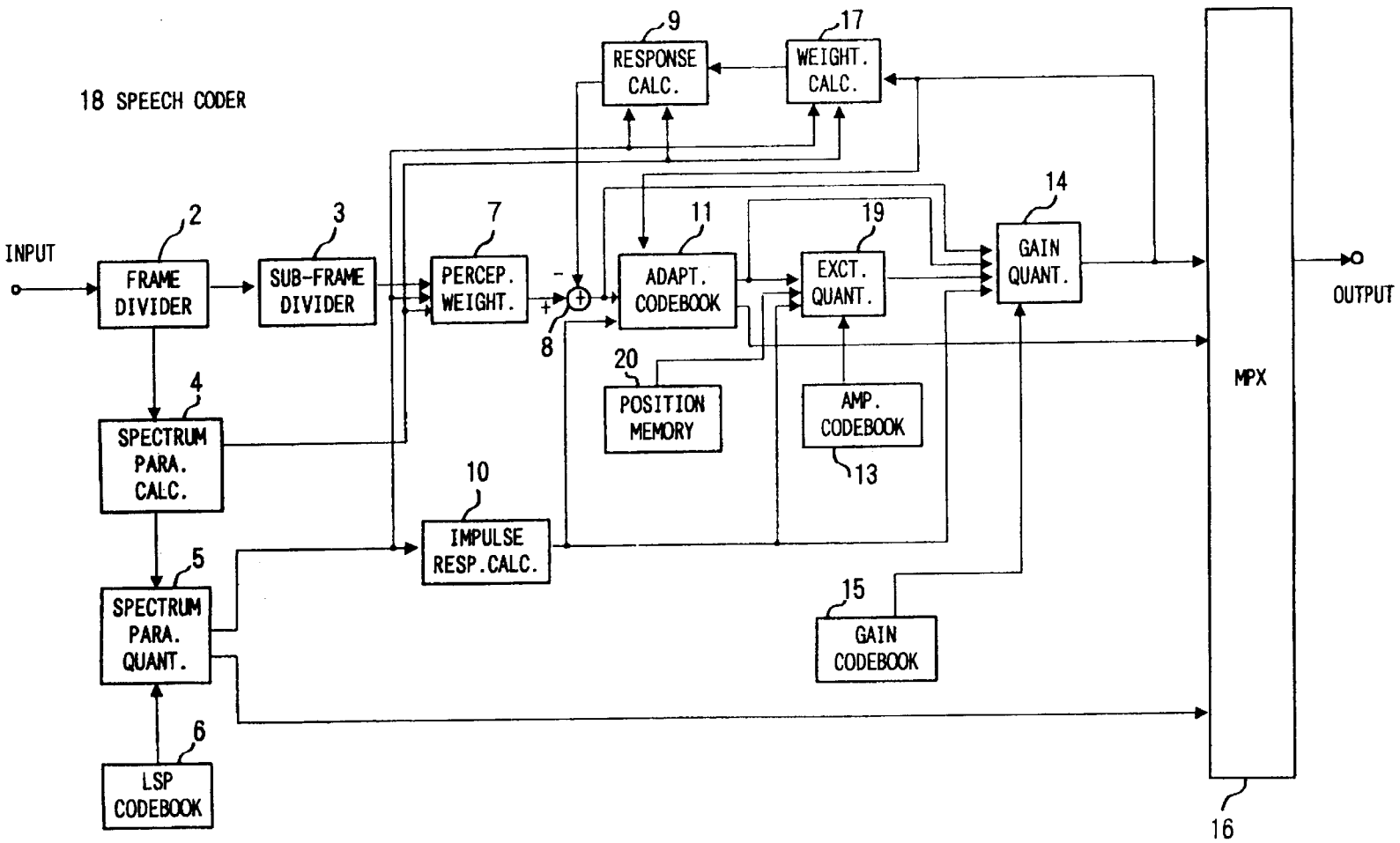
FIG. 2 shows a block diagram of a speech coder according to a second embodiment of the present invention.

FIG. 2 is a block diagram showing a second embodiment of the present invention. The second embodiment of the speech coder 18 is different from the first embodiment in that excitation quantizer 19 reads out pulse positions from pulse position storage circuit 20, at which pulse positions shown in a table referred to in connection with the function are stored. The excitation quantizer 19 selects a combination of pulse position and amplitude codevector which maximizes the equation (18) or (19) only with respect to the combination of the read-out pulse positions.

Figure 3:
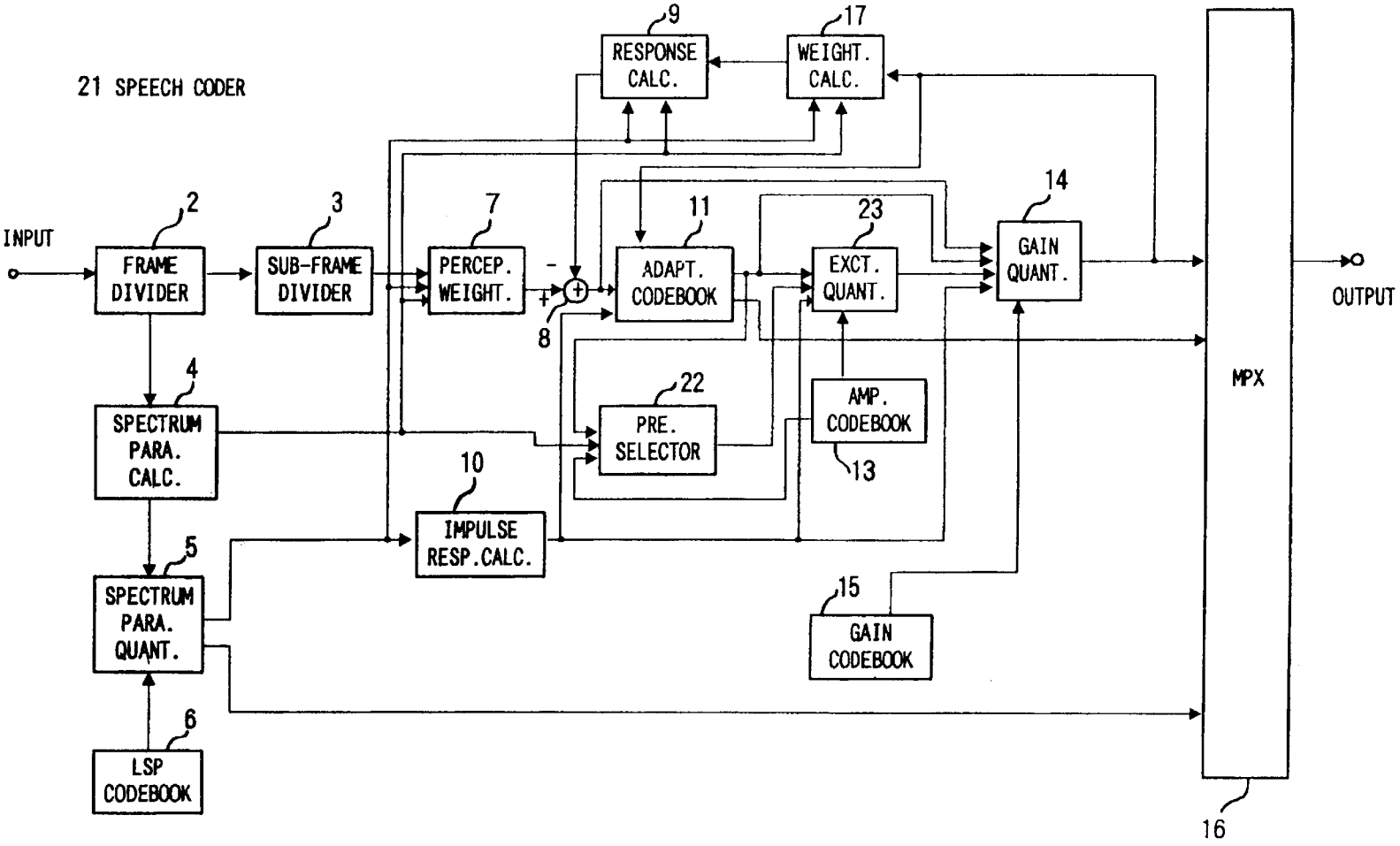
FIG. 3 shows a block diagram of a speech coder according to a third embodiment of the present invention.

FIG. 3 is a block diagram showing a third embodiment of the present invention. The third embodiment of the speech coder 21 is different from the first embodiment in that preliminary selector 22 is provided for preliminarily selecting a plurality of codevectors among the codevectors stored in the amplitude codebook 13. The preliminary codevector selection is executed as follows. Using the adaptive codebook output signal $e_w(n)$ and the spectral parameter $\alpha_i$, an error signal z(n) are calculated as $$z(n) = e_w(n) - \sum_{i=1}^{10} a_i \gamma^i e_w(n-i) \tag{24}$$

Then, a plurality of amplitude codevectors are preliminarily selected in the order of maximizing following equation (25) or (26), and are outputted to excitation quantizer 23.

$$D_K = \left[\sum_{n=0}^{N-1} z(n) \sum_{i=1}^{M} g_{ik}' \delta_w(m_i)\right]^2 \tag{25}$$

$$D_K = \left[\sum_{n=0}^{N-1} z(n) \sum_{i=1}^{M} g_{ik}' \delta_w(m_i)\right]^2 \Big/ \left[\sum_{i=1}^{M} g_{ik}' \delta_w(m_i)\right]^2 \tag{26}$$

The excitation quantizer 23 executes calculation of equation (18) or (19) only for the preliminarily selected amplitude codevectors, and outputs a combination of pulse position and amplitude codevector which maximizes the equation.

Figure 4:
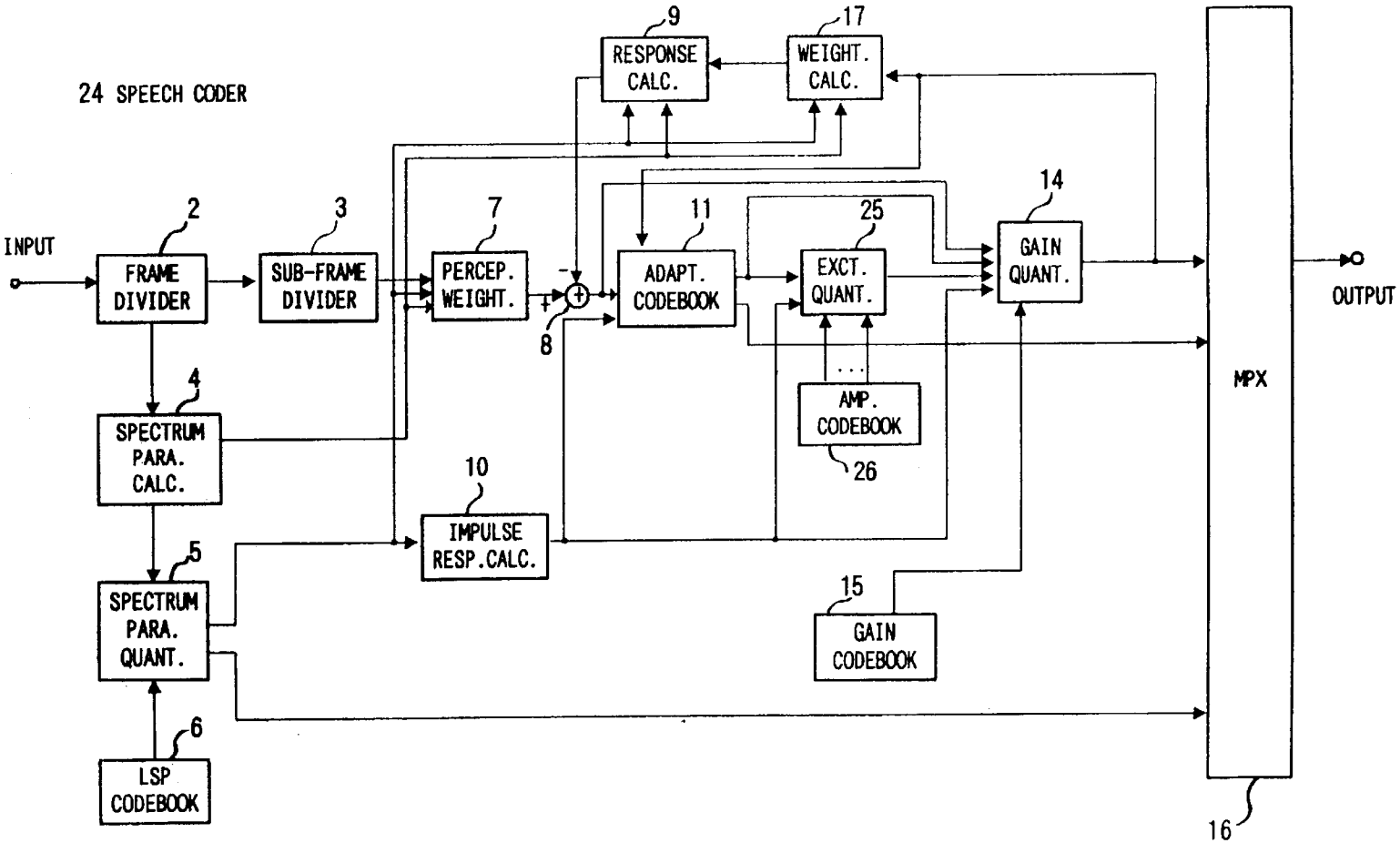
FIG. 4 shows a block diagram of a speech coder according to a fourth embodiment of the present invention.

FIG. 4 is a block diagram showing a fourth embodiment of the present invention.

The fourth embodiment of the speech coder 24 is different from the first embodiment in that a different type of excitation quantizer 25 calculates positions of a predetermined number M of pulses for a plurality of sets in a method according to Reference 12 or 3. It is here assumed for the sake of brevity that the calculation of the positions of M pulses is executed for two sets.

For the pulse positions in the first set, the excitation quantizer 25 reads out amplitude codebook from amplitude codebook 25, selects an amplitude codebook which maximizes the equation (18) or (19), and calculates first distortion D1 according to an equation defining distortion $$D_{(k,i)} = \sum_{n=0}^{N-1} e_w^2(n) - \left[\sum_{n=0}^{N-1} e_w(n) s_{wk}(m_i)\right]^2 \Big/ \sum_{n=0}^{N-1} s_{wk}^2(m_i) \tag{27}$$

Then, for the pulse positions in the second set, the excitation quantizer 25 reads out amplitude codevectors from the amplitude codebook 26, and calculates second distortion D2 in the same process as described above. Then the excitation quantizer 25 compares the first and second distortions, and selects a combination of pulse position and amplitude codevector which provides less distortion.

The excitation quantizer 25 then outputs an index representing the pulse position and amplitude codevector to the multiplexer 16.

Figure 5:
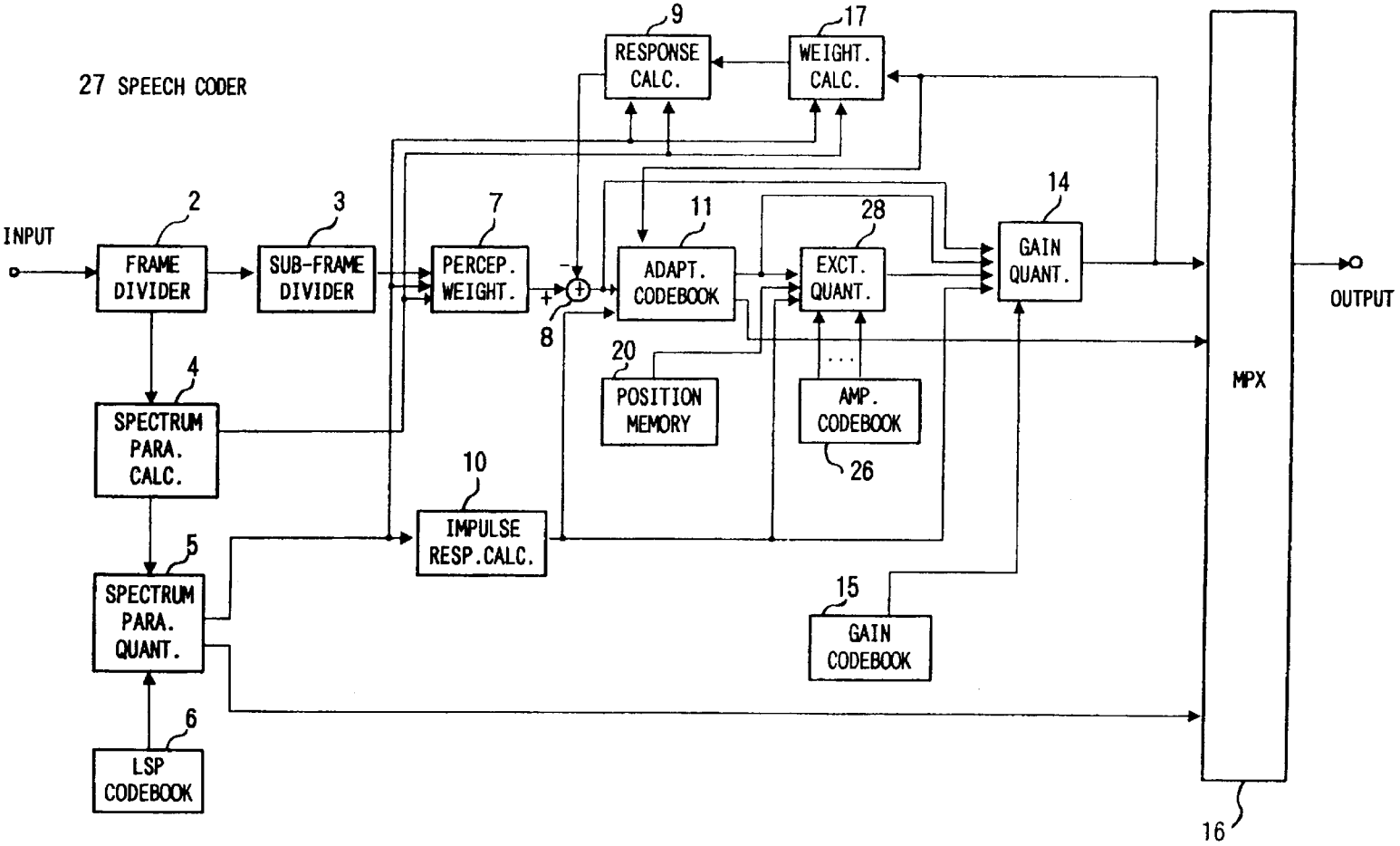
FIG. 5 shows a block diagram of a speech coder according to a fifth embodiment of the present invention.

FIG. 5 is a block diagram showing a fifth embodiment of the present invention. The fifth embodiment of the speech coder 24 is different from the fourth embodiment in that a different type of excitation quantizer 28, unlike the excitation quantizer 25 shown in FIG. 4, can take pulses at limited positions. Specifically, the excitation quantizer 28 reads out the limited pulse positions from pulse position storage circuit 20 selects M pulse positions from these pulse position combinations for two sets, and selects a combination of pulse position and amplitude codevector which maximizes equation (18) or (19). Then, the excitation quantizer 28 obtains pulse position in the same manner as in the first embodiment, quantizes this pulse position, and outputs the quantized pulse position to the multiplexer 16 and the gain quantizer 14.

Figure 6:
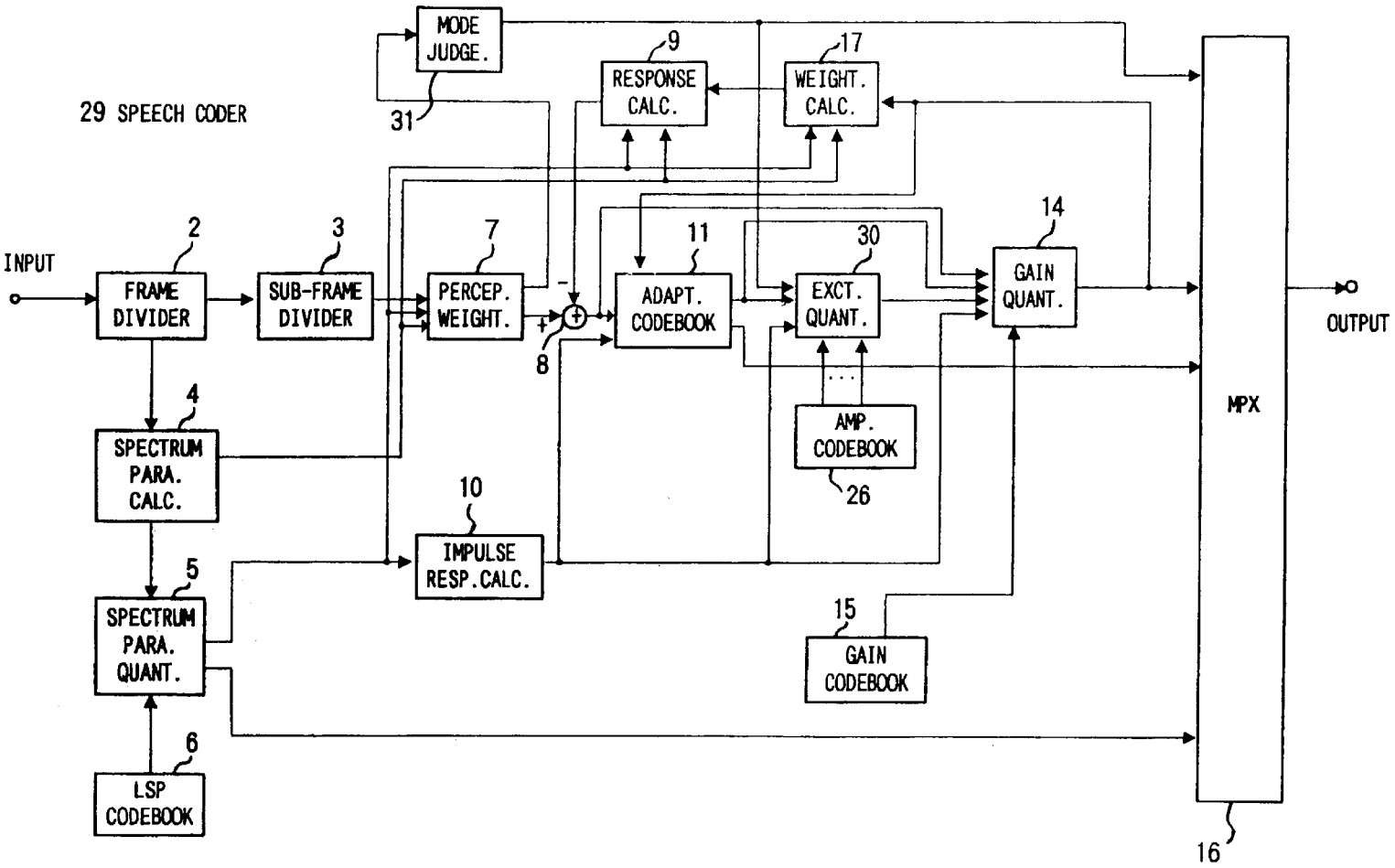
FIG. 6 shows a block diagram of a speech coder according to a sixth embodiment of the present invention.

FIG. 6 is a block diagram showing a sixth embodiment of the invention.

The sixth embodiment of the speech coder 29 is different from the fourth embodiment in that a mode judgment circuit 31 is provided. The mode judgment circuit 31 receives a perceptual weight multiplied signal for each frame from the perceptual weight multiplier 7, and outputs mode judgment data to excitation quantizer 30. The mode judgment is executed by using a feature quantity of the present frame. As the feature quantity, frame mean pitch prediction gain may be used. The pitch prediction gain is calculated by using, for instance, an equation $$G = 10\log_{10}\left[1/L\sum_{i=1}^{L}(P_i/E_i)\right] \tag{28}$$

where L is the number of sub-frames included in the frame, and $P_i$ and $E_i$ are speech power and pitch prediction error power, respectively, in i-th sub-frame.

$$P_i = \sum_{n=0}^{N-1} X_{Wi}^2(n) \tag{29}$$

$$E_i = P_i - \left[\sum_{n=0}^{N-1} X_{wi}(n) X_{wi}(n-T)\right]^2 \Big/ \left[\sum_{n=0}^{N-1} X_{wi}^2(n-T)\right] \tag{30}$$

where T is the optimal delay for maximizing the pitch prediction gain.

The frame mean pitch prediction gain G is classified into a plurality of different modes in comparison to a plurality of predetermined thresholds. The number of different modes is 4, for instance. The mode judgment circuit 31 outputs mode judgment data to the excitation quantizer 30 and the multiplexer 16.

The excitation quantizer 30 receives the mode judgment data and, when the mode judgment data represents a predetermined mode, executes the same process as in the excitation quantizer shown in FIG. 4.

Figure 7:
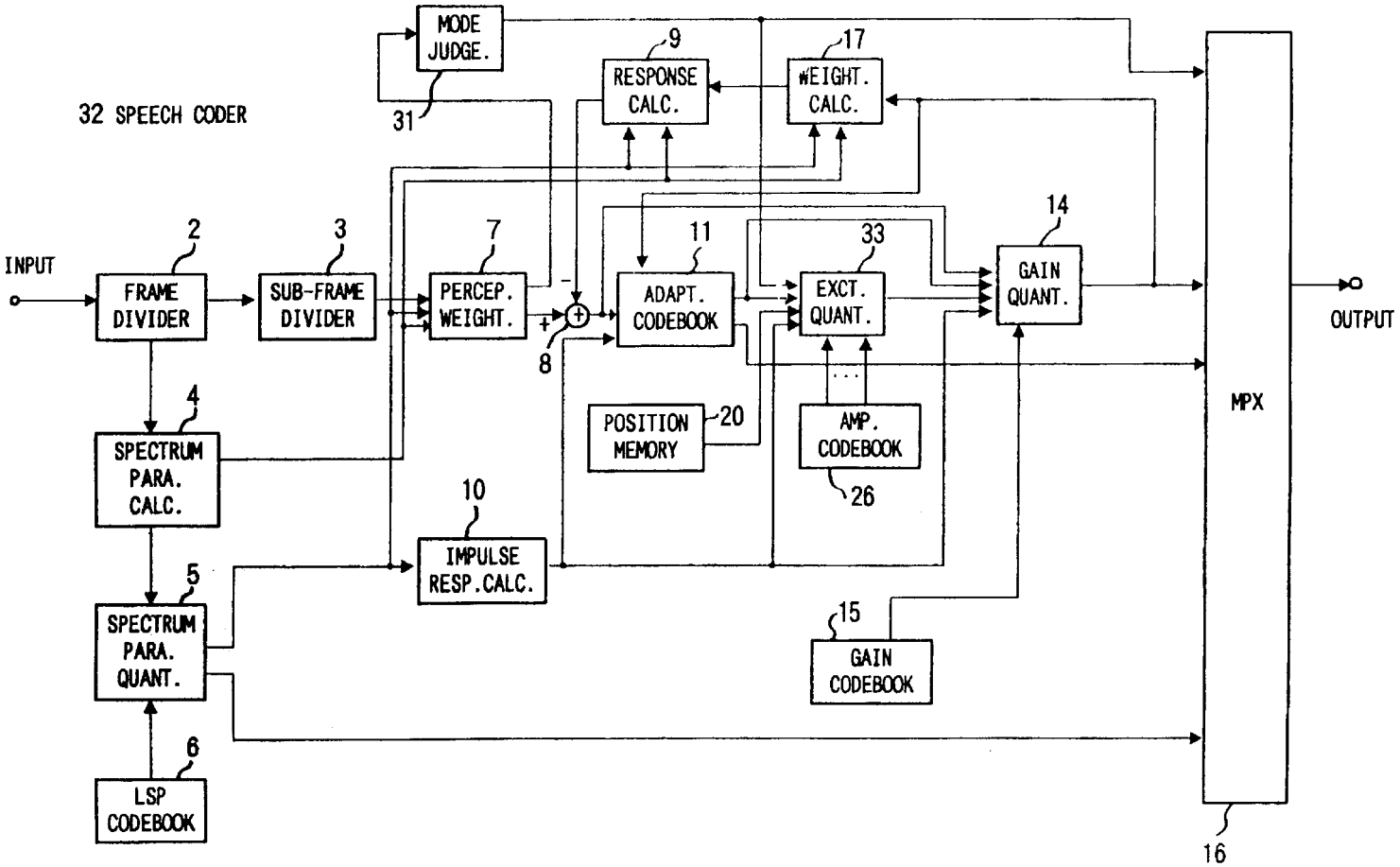
FIG. 7 shows a block diagram of a speech coder according to a seventh embodiment of the present invention.

FIG. 7 is a block diagram showing a seventh embodiment. The seventh embodiment of the speech coder 29 is different from the sixth embodiment in that a different excitation quantier 33, unlike the excitation quantizer 30 in the sixth embodiment, can take pulses at limited positions. The excitation quantizer 33 reads out the limited pulse positions from pulse position storage circuit 20 selects M pulse positions from these pulse position combinations for two sets, and selects a combination of pulse position and amplitude codevector which maximizes the equation (18) or (19).

Figure 8:
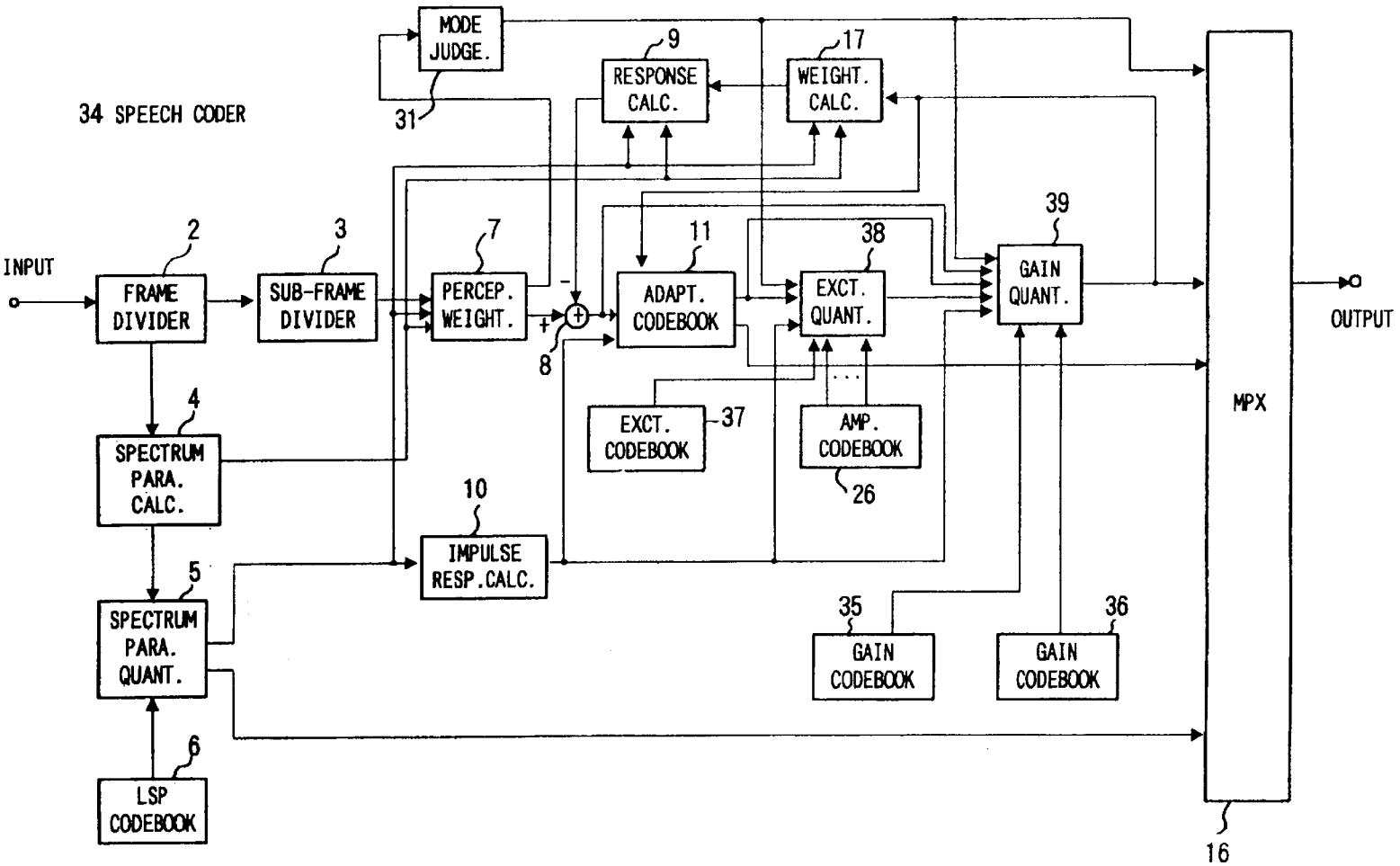
FIG. 8 shows a block diagram of a speech coder according to an eighth embodiment of the present invention.

FIG. 8 is a block diagram showing an eighth embodiment. The eighth embodiment of the speech coder 34 is different from the sixth embodiment by the provision of two gain codebooks 35 and 36 and an excitation codebook 37. Excitation quantizer 38 switches excitation according to the mode determined by mode judgment circuit 31. In one mode determined by mode judgment circuit 31, the excitation quantizer 38 executes the same operation as that in the excitation quantizer 30 in the sixth embodiment; i.e., it generates an excitation signal from a plurality of pulses and obtains a combination of pulse position and amplitude codevector. In another mode, the excitation quantizer 38, as described before, generates an excitation signal as a linear combination of a plurality of pulses and excitation codevectors selected from the excitation codebook 37, as given by the equation (5). Then the excitation quantizer 38 retrieves the amplitude and position of pulses and retrieves the optimum excitation codevector. Gain quantizer 39 switches the gain codebooks 35 and 36 in dependence on the determined mode in correspondence to the excitation.

Figure 9:
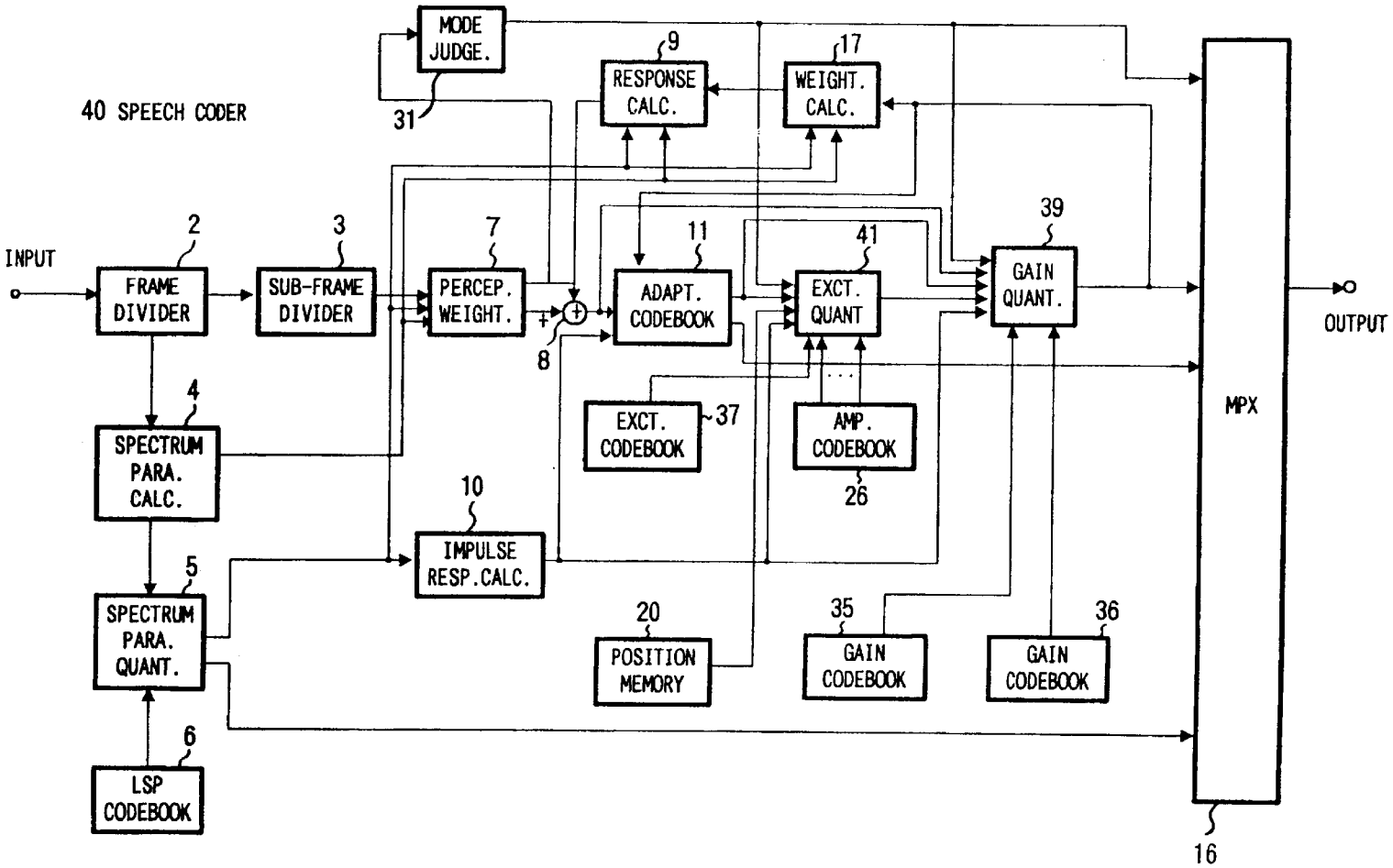
FIG. 9 shows a block diagram of a speech coder according to a ninth embodiment of the present invention.

FIG. 9 is a block diagram showing a ninth embodiment of the present invention. The ninth embodiment of the speech coder 40 is different from the eighth embodiment in that excitation quantizer 41, unlike the excitation quantizer 38 in the eighth embodiment, can take pulses at limited positions. Specifically, the excitation quantizer 41 reads out the limited pulse positions from pulse position storage circuit 20, and selects a combination of pulse position and amplitude codevector from these pulse position combinations.

The above embodiments are by no means limitative, and various changes and modifications are possible.

For example, it is possible to permit switching of the adaptive codebook circuit and the gain codebook by using mode judgment data.

Also, the gain quantizer may, when making gain codevector retrieval for minimizing the equation (21), output a plurality of amplitude codevectors from the amplitude codebook, and select a combination of amplitude codevector and gain codevector such as to minimize the equation (21) for each amplitude codevector. Further performance improvement is obtainable such that the amplitude codevector retrieval for the equations (18) and (19) is executed by executing orthogonalization with respect to adaptive codevectors.

The orthogonalization is executed such as $$q_k(n)=s_{wk}(n)-[\Psi_k/\Psi]b_w(n) \tag{31}$$

Here, $$\Psi_k = \sum_{n=0}^{N-1} b_w(n)q_k(n) \tag{32}$$

where $b_w(n)$ is a reproduced signal obtained as a result of weighting with adaptive codevector and $$b_w(n)=\beta v(n-T)*h_w(n) \tag{33}$$

By the orthogonalization, the adaptive codevector term is removed, so that an amplitude codevector which maximizes the following equation (34) or (35) may be selected.

$$D_{(k,i)} = \left(\left[\sum_{N=0}^{N-1} x'_w(n)q_k(n)\right]\right)^2 \Big/ \sum_{n=0}^{N-1} q_k^2(n) \tag{34}$$

$$D_k = \left(\left[\sum_{n=0}^{N-1} \phi'(n)v_k(n)\right]\right)^2 \Big/ \sum_{n=0}^{n-1} q_k^2(n) \tag{35}$$

Here, $$\phi'(n) = \sum_{i=n}^{N-1} x'_w(i)h_w(i-n),\ n = 0, \ldots, N-1 \tag{36}$$

As has been described in the foregoing, according to the present invention, the excitation in the excitation quantization unit is constituted by a plurality of pulses, and a codebook for collectively quantizing either of the amplitude and position parameters of the pulses is provided and retrieved for calculation of the other parameter. It is thus possible to improve the speech quality compared to the prior art with relatively less computational effort even at the same bit rate. In addition, according to the present invention, a codebook for simultaneously quantizing the amplitude of pulses is provided, and after calculation of pulse positions for a plurality of sets, a best combination of pulse position and codevector is selected by retrieving the position sets and the amplitude codebook. It is thus possible to improve the speech quality compared to the prior art system. Moreover, according to the present invention the excitation is expressed, in dependence on the mode, as a plurality of pulses or a linear coupling of a plurality of pulses and excitation codevectors selected from the excitation codebook. Thus, speech quality improvement compared to the prior art is again obtainable with a variety of speech signals.

Changes in construction will occur to those skilled in the art and various apparently different modifications and embodiments may be executed without departing from the scope of the present invention. The matter set forth in the foregoing description and accompanying drawings is offered by way of illustration only. It is therefore intended that the foregoing description be regarded as illustrative rather than limiting.

What is claimed is:

1. A speech coder comprising:

a spectral parameter calculator that generates a quantized spectral parameter from an input speech signal;

an excitation quantizer that derives an excitation signal from the input speech signal using the spectral parameter and outputs the excitation signal in quantized form, the excitation signal comprising a plurality of non-zero pulses, each non-zero pulse being characterized by a pulse position parameter and a pulse amplitude parameter; and a codebook that simultaneously quantizes one of the pulse position parameter and the pulse amplitude parameter of all of the non-zero pulses, the excitation quantizer being operative to quantize the non-zero pulses by computation using the one parameter obtained by retrieval of the codebook to determine the other of the pulse position parameter and the pulse amplitude parameter.

2. The speech coder according to claim 1, wherein the excitation quantizer has at least one specific pulse position at which a pulse is taken.

3. The speech coder according to claim 1, wherein the excitation quantizer preliminarily selects a plurality of codevectors from the codebook and executes the quantization by obtaining the other parameter by retrieval of the preliminarily selected codevectors.

4. The speech coder according to claim 1, wherein the codebook quantizes the amplitude parameter of the plurality of non-zero pulses.

5. The speech coder according to claim 1, further including a position memory that stores a plurality of predetermined pulse-position combinations; and wherein the excitation quantizer is operative to derive the excitation signal using the codebook entries and the succession of pulse-position combinations stored in the position memory.

6. The speech coder according to claim 1, wherein the excitation quantizer is operative to perform a preliminary selection of entries from the codebook according to a predetermined algorithm, and to assign, in succession, to each of the preliminarily selected codebook entries, possible positions that may be assumed by each of the plurality of pulses.

7. The speech coder according to claim 1, further including a frame dividing circuit that divides the incoming speech signal into a succession of N-pulse frames, and wherein:

the spectral parameter is extracted and quantized on a frame-by-frame basis;

the excitation is in the form of an M-pulse codevector (M<N) having only non-zero pulses, each of which pulses can assume a predetermined quantized amplitude and position;

the entries in the code book comprise permutations of quantized amplitude values which can be assumed by each of the M pulses, but no information as the position of each of the M pulses; and the excitation quantizer is operative to assign, in succession, to each of the codebook entries, possible positions that may be assumed by each of the M pulses thereof, and to perform a computation to determine which position-amplitude combination results in a reconstructed speech signal which most closely approximates the input speech signal.

8. The speech coder according to claim 7, further including a position memory that stores a plurality of predetermined pulse-position combinations; and wherein the excitation quantizer is operative to assign, in succession, to each of the codebook entries, the succession of pulse-position combinations stored in the position memory, and to perform a computation to determine which position-amplitude combination results in a reconstructed speech signal which most closely approximates the input speech signal.

9. The speech coder according to claim 7, wherein the excitation quantizer is operative to:

perform a preliminary selection of entries from the codebook according to a predetermined algorithm;

assign, in succession, to each of the preliminarily selected codebook entries, possible positions that may be assumed by each of the M pulses thereof; and perform a computation to determine which position-amplitude combination results in a reconstructed speech signal which most closely approximates the input speech signal.

10. The speech coder according to claim 9, further including an adaptive codebook, and pitch prediction circuitry operative in conjunction with the adaptive codebook, and wherein the predetermined preliminary selection algorithm employs an output of the adaptive codebook and the spectral parameter.

11. A method of speech encoding comprising:

generating a quantized spectral parameter from a speech signal;

deriving an excitation signal from the speech signal, the excitation signal comprising a plurality of non-zero pulses, each non-zero pulse being characterized by a pulse position parameter and a pulse amplitude parameter; and simultaneously quantizing one of the pulse position parameter and the pulse amplitude parameter of the plurality of non-zero pulses; and determining the other of the pulse position parameter and the pulse amplitude parameter using the quantized parameter of the plurality of non-zero pulses.

12. The method of speech encoding according to claim 11, further comprising taking a pulse at at least one specific pulse position.

13. The method of speech encoding according to claim 11, further comprising selecting a plurality of codevectors from a code book, wherein the other of the pulse position parameter and the pulse amplitude parameter is determined using the selected plurality of codevectors.

14. The method of speech encoding according to claim 11, further comprising:

dividing the speech signal into a succession of N-pulse frames;

extracting and quantizing the spectral parameter on a frame-by-frame basis, the excitation signal being in the form of an M-pulse codevector (M<N) having only non-zero pulses, each pulse of which can assume a predetermined quantized amplitude and position;

assigning, in succession, possible positions that may be assumed by each of the M pulses; and performing a computation to determine which position-amplitude combination results in a reconstructed speech signal which most closely approximates the speech signal.

15. The method of speech encoding according to claim 14, further comprising performing a preliminary selection of codebook entries according to a predetermined algorithm.

16. The method of speech encoding according to claim 15, further comprising assigning, to each of the preliminarily selected codebook entries, possible positions that may be assumed by each of the plurality of pulses.

17. The method of speech encoding according to claim 11, wherein the amplitude parameter of the plurality of non-zero pulses is quantized.

18. The method of speech encoding according to claim 11, further comprising:

storing a plurality of predetermined pulse-position combinations; and deriving the excitation signal using the stored plurality of pulse-position combinations.

* * * * *